US009603225B2

(12) United States Patent
Thijssen

(10) Patent No.: US 9,603,225 B2
(45) Date of Patent: Mar. 21, 2017

(54) CONFIGURING A NETWORK CONNECTED LIGHTING SYSTEM

(71) Applicant: PHILIPS LIGHTING HOLDING B.V., Eindhoven (NL)

(72) Inventor: Paulus Thomas Arnoldus Thijssen, Goirle (NL)

(73) Assignee: PHILIPS LIGHTING HOLDING B.V., Eindhoven (NL)

( * ) Notice: Subject to any disclaimer, the term of this patent is extended or adjusted under 35 U.S.C. 154(b) by 0 days.

(21) Appl. No.: 15/086,668

(22) Filed: Mar. 31, 2016

(65) Prior Publication Data

US 2016/0295669 A1 Oct. 6, 2016

(30) Foreign Application Priority Data

Mar. 31, 2015 (EP) ..... 15161977

(51) Int. Cl.
*H05B 37/02* (2006.01)

(52) U.S. Cl.
CPC ..... *H05B 37/0254* (2013.01); *H05B 37/0272* (2013.01)

(58) Field of Classification Search
CPC .. H05B 37/02; H05B 37/029; H05B 37/0245; H05B 37/0254; H05B 37/0272; H05B 37/034; H05B 33/0842; H05B 33/0854; H05B 33/0863; Y02B 20/48
USPC ..... 315/312, 313, 314, 318, 307, 294, 297
See application file for complete search history.

(56) References Cited

U.S. PATENT DOCUMENTS

| | | | | |
|---|---|---|---|---|
| 7,202,613 | B2 * | 4/2007 | Morgan | A01M 1/04 315/312 |
| 7,242,152 | B2 * | 7/2007 | Dowling | H05B 37/029 315/169.1 |
| 9,066,381 | B2 * | 6/2015 | Valois | H05B 37/0227 |
| 2008/0089242 | A1 | 4/2008 | Whitten | |
| 2008/0122384 | A1 | 5/2008 | Chan | |
| 2008/0212493 | A1 | 9/2008 | Lenz et al. | |
| 2014/0265927 | A1 | 9/2014 | Mohan et al. | |
| 2015/0048758 | A1 | 2/2015 | Carrigan et al. | |

FOREIGN PATENT DOCUMENTS

| | | | |
|---|---|---|---|
| WO | 2008078256 | A2 | 7/2008 |
| WO | 2010095087 | A1 | 8/2010 |

* cited by examiner

*Primary Examiner* — Haissa Philogene
(74) *Attorney, Agent, or Firm* — Meenakshy Chakravorty

(57) ABSTRACT

A lighting system device for a pre-configured lighting system (111), wherein the lighting system device is coupled directly with at least one further lighting system device in the pre-configured lighting system (111) based on configuration data associated with the lighting system device and the at least one further lighting system device, the lighting system device further configured to: store the configuration data associated with the lighting system device and the at least one further lighting system device such that it is not deleted on performing a reset; receive a reset input; cascade the reset input to any coupled lighting system devices within the pre-configured lighting system package; reset the lighting system device; and determine and register the lighting system device on a central control unit (101), such that the central control unit (101) is configured to access the configuration data and restore a pre-configured lighting system functionality.

15 Claims, 5 Drawing Sheets

CONFIGURING A NETWORK CONNECTED LIGHTING SYSTEM

CROSS-REFERENCE TO PRIOR APPLICATIONS

This application claims the benefit European Patent Application No. 15161977.2, filed on Mar. 31, 2015. This application is hereby incorporated by reference herein.

TECHNICAL FIELD

The present disclosure relates to configuring a lighting system over a communication system, the lighting system comprising one or more lighting devices such as one or more luminaires for illuminating a room or other environment.

BACKGROUND

Most environments are provided with one or more lighting devices in the form of one or more luminaires for illuminating the environment so that occupants can find their way about and/or see objects within the environment, typically flooding the environment with light generally, or at least part of it. Other types of lighting device include for example luminaires for providing lighting effects, e.g. as part of a light show or stage lighting.

Traditionally the lights are controlled by means of the user manually pressing a light switch or turning a dimmer switch. Nowadays, lights can also be controlled remotely via another device such as a user terminal, and even a mobile user terminal such as a smartphone, tablet or laptop computer. To do so (e.g. in response to a user input), the controlling device transmits one or more lighting control commands via a network, destined for a receive-side control unit of the lighting system. This involves a suitable transmitter of the controlling device which is used to send the lighting control commands to an interface of the network, from whence the command message is directed onwards over the network to its destination.

For example, one possibility is to control the lights via Wi-Fi. In this case the network comprises at least an interface in the form of a wireless access point configured to operate in accordance with a Wi-Fi communications standard, and the controlling device (e.g. user terminal) comprises a corresponding transmitter configured to connect to the access point using Wi-Fi. The controlling device can then send lighting control commands to the lighting system via this connection with the access point, the command messages being sent onwards from the access point to the lighting system's own controller.

In another example, the lights may be controlled via another short-range RF access technology in the form of ZigBee. In this case a conventional access point may not be involved, e.g. the transmitter on the controlling device may be configured to use a ZigBee communications standard to send one or more control commands to a corresponding ZigBee bridge or central controller interface of the lighting system which forwards the control commands to the particular luminaire.

Converting a traditional lighting system to a remote controlled lighting system can be costly and require the removal of serviceable equipment. To reduce the cost the components of devices, such as switches, sensors and light units may be packaged as pre-configured or 'ConnectedReady' devices. Such preconfigured or 'ConnectedReady' devices are packaged and sold to operate together as an independent set and communicate directly with each other. For example a switch and light unit can be pre-configured together and sold to be installed in a room to replace a traditional lighting system for a room when the light unit or switch unit in the room fails.

Such 'ConnectedReady' package furthermore may be configured to be expandable in that a central control unit or bridge may be installed at a later time and all of the devices configured to operate with the central control unit or bridge. In such systems only the switches, sensors and light units which need to be replaced are replaced and the ability to add a central control unit enables the cost to be spread as well as reducing the amount of waste caused by scrapping or disposing usable equipment.

In such packages the actuator device (such as the light unit) and the control device (the wall switch) can be pre-commissioned and configured to work independently of other devices. As such they can be considered to have their own private communications network (such as ZigBee network).

The operation of upgrading the pre-configured sets or packages of devices to a centrally controlled network such as HUE system requires user actions to be performed in a specific order or the connected ready devices may not work correctly within the network. Furthermore the operation of upgrading a large number of connected ready devices furthermore may require a significant amount of time to fine tune the installation process.

For example to configure a simple pre-configured (or 'ConnectedReady') package such as a light unit and wall switch to a connected 'bridge' network (or Hue network) the user must separately reset the light unit and the wall switch to the factory reset or factory new mode. Then the user must instruct the controller unit or bridge to search for the 'new' devices. Furthermore the bridge has to be configured in order to bind the wall switch to the light unit. Although this example is simple where the user has a large number of packages to configure (such as a complete home conversion from pre-configured to bridge network setup) with many actuators and controllers to configure the configuration may become very complex and the possibility of errors leading to a connected system which cannot control all of the light units correctly is high.

SUMMARY

In a connected or networked lighting system, the ability to configure a pre-configured or pre-commissioned package of lighting devices such that they may be controlled by a bridge or central control unit lighting architecture without the errors caused by a manual configuration is desirable. In other words it would be useful to provide the possibility of configuring a network connected lighting system in a fast, hassle free and user friendly way; e.g. enabling a user in a particular room or environment to configure the pre-configured devices to form the bridge network system for the whole house or environment in a fast, hassle free and user friendly way.

According to a first aspect there is provided a lighting system device for a pre-configured lighting system, wherein the lighting system device is coupled directly with at least one further lighting system device in the pre-configured lighting system based on configuration data associated with the lighting system device and the at least one further lighting system device, the lighting system device further configured to: store the configuration data associated with the lighting system device and the at least one further lighting system device such that it is not deleted on performing a reset; receive a reset input;

cascade the reset input to any coupled lighting system devices within the pre-configured lighting system package; reset the lighting system device; and determine and register the lighting system device on a central control unit (101), such that the central control unit (101) is configured to access the configuration data and restore a pre-configured lighting system functionality.

In such a manner it is possible to convert the pre-configured lighting system comprising multiple devices configured to be coupled or communicate directly with each other to function using a central control unit.

The lighting system device configured to store the configuration data may be configured to store the configuration data on an external server.

In such a manner even when the device is completely reset to a factory new mode of operation and all of the configuration data is lost from the memory of the lighting device then the configuration data may be accessed by the central control unit from the external server.

The lighting system device may be configured to communicate the configuration data to a user equipment, wherein the user equipment may be configured to communicate the configuration data to the external server.

In such a manner the lighting system device may quickly and easily transfer the configuration data to the external server via the user equipment and thus may not need expensive transceiver equipment for long range communication but instead communicate using a short range method such as NFC or Bluetooth.

The lighting system device configured to store the configuration data may be configured to store the configuration data within a portion of a memory which is masked from being deleted on the lighting system device being reset.

The lighting system device may be further configured to: receive a request from the central control unit for the configuration data; and generate a response to the request, the response comprising the stored configuration data; and transmit to the central control unit the response such that the central control unit has access to the configuration data.

In such a manner even when the device is reset the memory storing the configuration data is not cleared and thus the configuration data is kept and may be accessed by the central control unit when the device registers at the central control unit.

The reset input may be a physical input.

In such embodiments the input may be a button, switch or other physical input and which may be a defined combination or sequence of physical inputs.

The reset input may be a received reset command message.

In such embodiments the input may thus be received from a device initializing a conversion process from a pre-configured package lighting system to one which may be controlled using a suitable central control unit or bridge.

The lighting system device configured to cascade the reset input to any coupled lighting system devices within the pre-configured lighting system package may be configured to: determine any directly coupled lighting system devices; generate a reset command message; and transmit the reset command message to each of the directly coupled lighting system devices to cascade the reset input.

In such a manner the reset may cascade through the lighting system devices and such a single input enable the whole system to then connect to the central control unit.

The lighting system device may be configured to mask any further received reset inputs after receiving the first reset input for a determined period.

For example in some embodiments the masking or blocking of any further reset inputs prevents the looping of resets occurring.

The lighting system device is one of: a controllable light unit; a light switch; and a sensor unit.

According to a second aspect there is provided a central control unit for configuring a pre-configured lighting system lighting system device, the central control unit configured to: register a reset lighting system device at the central control unit; request configuration data associated with the lighting system device and at least one further lighting system device; receive the configuration data; and generate a logical link between the lighting system device and at least one further lighting system device to restore a pre-configured lighting system functionality between the lighting system device and at least one further lighting system device.

In such embodiments the central control unit may therefore be able to re-establish the functionality of the pre-configured lighting system.

The central control unit configured to request configuration data associated with the lighting system device and at least one further lighting system device may be further configured to generate and transmit to an external server a request for configuration data associated with the lighting system device, and receive the configuration data within a response to the request from the external server.

In such embodiments the central control unit may access the configuration data from the external server and thus even if the lighting system device has deleted the configuration data by performing a complete or factory new reset then this configuration data may be retrieved.

The central control unit configured to request configuration data associated with the lighting system device and at least one further lighting system device may be further configured to generate and transmit to the lighting system device a request for configuration data associated with the lighting system device, and receive the configuration data within a response to the request from the lighting system device.

A networked lighting system may comprise: at least two lighting system devices as described herein; and a central control unit as described herein.

According to a third aspect there is provided a method for configuring a lighting system device, the lighting system device configured to operate as part of a pre-configured lighting system, wherein the lighting system device is coupled directly with at least one further lighting system device in the pre-configured lighting system based on configuration data associated with the lighting system device and the at least one further lighting system device, the method comprising: storing the configuration data associated with the lighting system device and the at least one further lighting system device such that it is not deleted on performing a reset; receiving a reset input; cascading the reset input to any coupled lighting system devices within the pre-configured lighting system package; resetting the lighting system device; and determining and registering the lighting system device on a central control unit, such that the central control unit is configured to access the configuration data and restore a pre-configured lighting system functionality.

Storing the configuration data may comprise storing the configuration data on an external server.

Storing the configuration data on an external server may comprise: transmitting the configuration data to a user equipment; and transmitting the configuration data from the user equipment to the external server.

Storing the configuration data may comprise storing the configuration data within a portion of a memory which is masked from being deleted when the lighting system device is reset.

The method may further comprise: receiving a request from the central control unit for the configuration data; generating a response to the request, the response comprising the stored configuration data; and transmitting to the central control unit the response such that the central control unit has access to the configuration data.

Receiving a reset input may comprise receiving a physical input.

Receiving a reset input may comprise receiving a reset command message.

Cascading the reset input to any coupled lighting system devices within the pre-configured lighting system package may comprise: determining any directly coupled lighting system devices; generating a reset command message; and transmitting the reset command message to each of the directly coupled lighting system devices to cascade the reset input.

The method may further comprise masking for a determined period any further received reset inputs after receiving the first reset input.

According to fourth aspect there is provided a method for managing a central control unit to configure a pre-configured lighting system lighting system device, the method comprising: registering a reset lighting system device at the central control unit; requesting configuration data associated with the lighting system device and at least one further lighting system device; receiving the configuration data; and generating a logical link between the lighting system device and at least one further lighting system device to restore a pre-configured lighting system functionality between the lighting system device and at least one further lighting system device.

Requesting configuration data associated with the lighting system device and at least one further lighting system device may further comprise: generating and transmitting to an external server a request for configuration data associated with the lighting system device; and receiving the configuration data within a response to the request from the external server.

Requesting configuration data associated with the lighting system device and at least one further lighting system device may further comprise: generating and transmitting to the lighting system device a request for configuration data associated with the lighting system device; and receiving the configuration data within a response to the request from the lighting system device.

According to a fifth aspect there is provided a computer program for controlling a lighting system device for a pre-configured lighting system, wherein the lighting system device is coupled directly with at least one further lighting system device in the pre-configured lighting system based on configuration data associated with the lighting system device and the at least one further lighting system device, and the computer program comprising code embodied on one or more computer-readable storage media and configured so as when run on the lighting system device to perform operations of: storing the configuration data associated with the lighting system device and the at least one further lighting system device such that it is not deleted on performing a reset; receiving a reset input; cascading the reset input to any coupled lighting system devices within the pre-configured lighting system package; resetting the lighting system device; and determining and registering the lighting system device on a central control unit, such that the central control unit is configured to access the configuration data and restore a pre-configured lighting system functionality.

Storing the configuration data may cause the lighting system device to further perform the operation of storing the configuration data on an external server.

Storing the configuration data on an external server may cause the lighting system device to further perform the operations of: transmitting the configuration data to a user equipment; and transmitting the configuration data from the user equipment to the external server.

Storing the configuration data may cause the lighting system device to further perform the operation of storing the configuration data within a portion of a memory which is masked from being deleted when the lighting system device is reset.

The lighting system device may further perform the operations of: receiving a request from the central control unit for the configuration data; generating a response to the request, the response comprising the stored configuration data; and transmitting to the central control unit the response such that the central control unit has access to the configuration data.

Receiving a reset input may cause the lighting system device to further perform the operation of receiving a physical input.

Receiving a reset input may cause the lighting system device to further perform the operation of receiving a reset command message.

Cascading the reset input to any coupled lighting system devices within the pre-configured lighting system package may cause the lighting system device to further perform the operations of: determining any directly coupled lighting system devices; generating a reset command message; and transmitting the reset command message to each of the directly coupled lighting system devices to cascade the reset input.

The lighting system may be further caused to perform the operation of masking for a determined period any further received reset inputs after receiving the first reset input.

According to a sixth aspect there is provided a computer program for managing a central control unit to configure a pre-configured lighting system lighting system device, the computer program comprising code embodied on one or more computer-readable storage media and configured so as when run on the central control unit to perform operations of: registering a reset lighting system device at the central control unit; requesting configuration data associated with the lighting system device and at least one further lighting system device; receiving the configuration data; and generating a logical link between the lighting system device and at least one further lighting system device to restore a pre-configured lighting system functionality between the lighting system device and at least one further lighting system device.

Requesting configuration data associated with the lighting system device and at least one further lighting system device may further cause the central control unit to further perform: generating and transmitting to an external server a request for configuration data associated with the lighting system device; and receiving the configuration data within a response to the request from the external server.

Requesting configuration data associated with the lighting system device and at least one further lighting system device may further cause the central control unit to further perform: generating and transmitting to the lighting system device a request for configuration data associated with the lighting system device; and receiving the configuration data within a response to the request from the lighting system device.

BRIEF DESCRIPTION OF THE DRAWINGS

To assist understanding of the present disclosure and to show how embodiments may be put into effect, reference is made by way of example to the accompanying drawings in which.

DETAILED DESCRIPTION OF EMBODIMENTS

The following discloses techniques whereby pre-configured or 'ConnectedReady' devices may be integrated into a networked lighting system. The same methods and apparatus described herein with respect to ConnectedReady' devices, which are typically sold as pre-configured packages may be applied to any devices connected as part of a bridgeless or distributed control setup (for example connected using a TouchLink configuration). Thus where the following description refers to pre-configured arrangements or packages of devices the same may be applied to any device which is operating in a bridgeless arrangement or configuration may be converted into a bridge or centrally controlled (Hue) network arrangement.

A benefit of such a system is that the effort required to integrate the devices into a networked lighting system such as a Hue lighting system is reduced, leading to lower installation cost and fewer installation errors.

Figure 1:
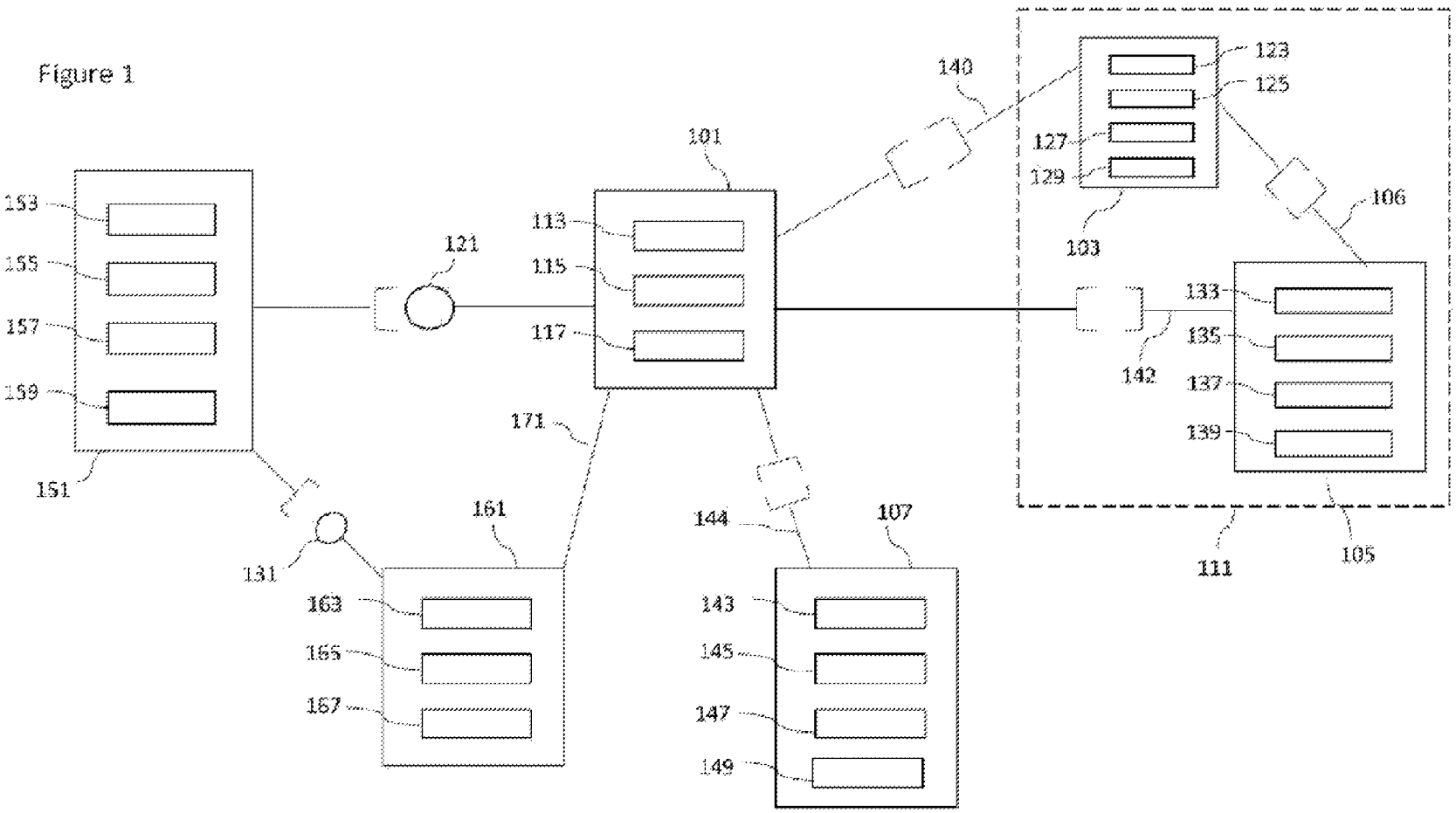
FIG. 1 is a schematic diagram of a system comprising a networked lighting system.

With respect to FIG. 1 an example connected or networked lighting system and associated devices configuration is shown. The networked lighting system shown in FIG. 1 shows an example Hue™ network but the concepts as discussed herein may be implemented within any suitable networked lighting system.

The networked lighting system may comprise a bridge or central control unit 101. The bridge may be configured to receive inputs from devices within the network such as light switches, sensors, and light units, and furthermore receive inputs from devices external or outside of the network such as external cloud or internet servers and user equipment. The bridge may furthermore process these inputs and generate suitable outputs which may be passed within the network, for example to control the light unit. Similarly the bridge 101 may be configured to generate suitable outputs which may be passed to devices outside of the network, for example to acknowledge a received input and output an indication that the light unit has been switched on.

The bridge 101 may comprise a processor or CPU 113, a memory 115, and a transceiver 117.

The processor 113 can in some embodiments be configured to execute various program codes. The implemented program codes in some embodiments comprise input monitoring, input processing, lighting system control output generating, and lighting system configuration code as described herein. The implemented program codes can in some embodiments be stored for example in the memory 115 for retrieval by the processor 113 whenever needed. The memory 115 could further provide a section for storing data, for example switch input, sensor or lighting system control signal data in accordance with the application as described herein.

The lighting system configuration code in embodiments can be implemented at least partially in hardware and/or firmware.

The bridge 101 in some embodiments comprises a transceiver (TX/RX) 117 suitable for enabling communication with other apparatus, for example via a wireless communication network. The transceiver 117 can communicate with other apparatus by any suitable known communications protocol, for example in some embodiments the transceiver 117 or transceiver means can use a suitable universal mobile telecommunications system (UMTS) protocol, a wireless local area network (WLAN) protocol such as for example IEEE 802.X, a suitable short-range radio frequency communication protocol such as Bluetooth, ZigBee or infrared data communication pathway (IRDA). In some embodiments the transceiver 117 may enable communication with other apparatus using more than one communications protocol or interface.

For example the bridge 101 may communicate using a bridge API 121 (over a WLAN protocol or IP domain communications link) with a user equipment 151, communicate over a further IP domain communications link with an external cloud or internet server 161, communicate over a Zigbee light link 142 with a light unit 105, communicate over a Zigbee sensor link 144 with a sensor device 107 and communicate over a Zigbee switch link 140 with a light switch 103.

Although in the example shown in FIG. 1 there is a single bridge 101 it is understood that in some embodiments there may be more than one bridge 101 or control unit distributed through the system. In some embodiments the multiple bridge or control units may be configured to communicate with each other and may distribute the control functionality as discussed herein. However it is understood that in some embodiments one of the bridge or control units may operate as a master bridge or control unit and the other bridge or control units operate as slave or dumb control units forwarding messages between connected devices and the master bridge or control unit.

The networked lighting system may comprise various input and output devices. For example in FIG. 1 is shown a light switch 103, a light unit 105, and a sensor unit 107 as example devices. It is understood that the number and distribution of the devices in the network may be any suitable distribution. Furthermore in some embodiments the light switch 103 and light unit 105 are initially a pre-configured or 'ConnectedReady' package 111 of devices which do not communicate with the bridge but may be configured as discussed herein to form part of the networked lighting system.

The light switch 103 may be configured to receive a user input and communicate the input as a command to the light unit 105. In some examples the communication of the command may be a direct communications link 106 such as employed when the light switch 103 and light unit 105 are part of a pre-configured or 'ConnectedReady' package 111 of devices which do not communicate with the bridge 101. In such an example the light switch 103 may be configured to transmit a 'LightOn' command over the direct communications link 106 to the light unit 105. However the light switch 103 may furthermore be configured to supply a bridge 101 with a switch input, such as a 'pressed' notification which is passed to the bridge 101.

The light switch 103 may comprise a processor or CPU 123, a memory 125, a transceiver 127 and a user interface or user input 129.

The processor 123 can in some embodiments be configured to execute various program codes. The implemented program codes in some embodiments comprise user input monitoring, user input processing, lighting system control output generating, and lighting system configuration code as described herein. The implemented program codes can in some embodiments be stored for example in the memory 125 for retrieval by the processor 123 whenever needed. The memory 125 could further provide a section for storing data, for example switch input, sensor or lighting system control signal data in accordance with the application as described herein.

The light switch 103 in some embodiments comprises a transceiver (TX/RX) 127 suitable for enabling communication with other apparatus, for example via a wireless communication network. The transceiver 127 can communicate with other apparatus by any suitable known communications protocol, for example in some embodiments the transceiver 127 or transceiver means can use a ZigBee communications link to communicate with the light unit 105 and/or the bridge 101.

The light switch user interface (UI) 129 enables a user to input commands to the lighting system. The user interface 129, may for example be keypad, physical switch, touch interface configured to detect a user touch, or an interface for determining touchless gesture controls. In some embodiments the UI 129 may be configured to provide information to the user, for example a light emitting diode illuminating a switch or part of the light switch to indicate when a light unit is on or off. In some embodiments the UI 129 may be a visual display, for example an LCD, LED or other display technology. In some embodiments a touch screen may provide both input and output functions for the UI 129.

The light unit 105 may be configured to receive a light unit command and other messages from the bridge 101 and/or the light switch 103. In some examples the command may be received over a direct communications link 106 such as employed when the light switch 103 and light unit 105 are part of a pre-configured or 'ConnectedReady' package 111 of devices which do not communicate with the bridge 101. In such an example the light unit 105 may be configured to receive a 'LightOn' command over the direct communications link 106 from the light switch 103. However the light unit 105 may furthermore be configured to receive messages such as light commands from the bridge 101 over the Zigbee light link 142.

The light unit 105 may comprise a processor or CPU 133, a memory 135, a transceiver 137 and at least one controllable light generating element 139.

The processor 133 can in some embodiments be configured to execute various program codes. The implemented program codes in some embodiments comprise control command monitoring, command processing, power control for the light element, and lighting system configuration code as described herein. The implemented program codes can in some embodiments be stored for example in the memory 135 for retrieval by the processor 133 whenever needed. The memory 135 could further provide a section for storing data, for example control signal data in accordance with the application as described herein.

The light unit 105 in some embodiments comprises a transceiver (TX/RX) 137 suitable for enabling communication with other apparatus, for example via a wireless communication network. The transceiver 137 can communicate with other apparatus by any suitable known communications protocol, for example in some embodiments the transceiver 137 or transceiver means can use a ZigBee communications link to communicate with the light switch 103 and/or the bridge 101.

The controllable light generating element 139 may be any suitable controllable light generating element such as light emitting diodes as well as incandescent, halogen, fluorescent and high-intensity discharge lamps. The controllable light generating element 139 may for example be controllable in intensity and/or color.

The sensor unit 107 may be configured to determine an environmental input (for example temperature or motion) and communicate the input to the bridge 101. In some examples the communication of the input may be supplied to the bridge 101 over a Zigbee connection 144.

The sensor unit 107 may comprise a processor or CPU 143, a memory 145, a transceiver 147 and a sensor 149.

The processor 143 can in some embodiments be configured to execute various program codes. The implemented program codes in some embodiments comprise sensor monitoring, lighting system sensor message generating, and lighting system configuration code as described herein. The implemented program codes can in some embodiments be stored for example in the memory 145 for retrieval by the processor 143 whenever needed. The memory 145 could further provide a section for storing data, for example sensor data in accordance with the application as described herein.

The sensor unit 107 in some embodiments comprises a transceiver (TX/RX) 147 suitable for enabling communication with other apparatus, for example via a wireless communication network. The transceiver 147 can communicate with other apparatus by any suitable known communications protocol, for example in some embodiments the transceiver 147 or transceiver means can use a ZigBee communications link to communicate with the bridge 101.

The sensor 149 may be any suitable sensor type or configuration. For example the sensor may be a temperature sensor, a passive infra-red sensor for monitoring whether there are people in the room, or a camera.

Although the examples shown here show devices which are light units, light switches or sensor units it is understood that in some embodiments the sensor unit functionality may be implemented within a light unit or light switch.

Furthermore the system shown in FIG. 1 further shows an external or cloud server 161. The external or cloud server 161 may be configured to communicate with the bridge 101 via an internet protocol (TCP IP) or similar communications link 171. Furthermore the external server 161 may be configured to communicate with a user equipment 151. The external server 161 may for example be employed to store configuration data used by the bridge 101 when configuring the networked lighting system as described herein.

The external server 161 may comprise a processor or CPU 163, a memory 165, and a transceiver 167.

The processor 163 can in some embodiments be configured to execute various program codes. The implemented program codes in some embodiments comprise lighting system configuration code as described herein. The implemented program codes can in some embodiments be stored for example in the memory 165 for retrieval by the processor 163 whenever needed. The memory 165 could further provide a section for storing data, for example switch input, sensor or lighting system control signal data in accordance with the application as described herein.

The external server 161 in some embodiments comprises a transceiver (TX/RX) 167 suitable for enabling communication with other apparatus. The transceiver 167 can communicate with other apparatus by any suitable known communications protocol, for example in some embodiments the transceiver 167 or transceiver means can use a TCP IP communications link 171 to communicate with the bridge 101 and furthermore support the operation of remote APIs over a further communications link 131 in order to communicate with a user equipment 151.

The user device or user equipment 151 may for example be a computing device configured to execute a lighting control program or similar and configured to access the bridge using bridge APIs. The user equipment 151 may for example be a mobile phone, tablet computer, laptop computer, desktop computer or similar. The user equipment may thus be configured to operate as a remote light switch and/or as a 'remote' sensor. The user equipment 151 may also be configured to receive information from a device within the lighting system, such as configuration information from a light switch or light unit within a pre-configured package and be able to store or transfer this information such that when the devices are configured as part of the networked lighting system comprising the bridge the devices may be re-configured correctly.

The user equipment 151 may comprise a processor or CPU 153, a memory 155, a transceiver 157 and a user interface 159.

The processor 153 can in some embodiments be configured to execute various program codes. The implemented program codes in some embodiments comprise input generation and lighting system configuration code as described herein. The implemented program codes can in some embodiments be stored for example in the memory 155 for retrieval by the processor 153 whenever needed. The memory 155 could further provide a section for storing data, for example switch input, sensor or lighting system control signal data in accordance with the application as described herein.

The user equipment 151 in some embodiments comprises a transceiver (TX/RX) 157 suitable for enabling communication with other apparatus, for example via a wireless communication network. The transceiver 157 can communicate with other apparatus by any suitable known communications protocol, for example in some embodiments the transceiver 157 or transceiver means can use a suitable universal mobile telecommunications system (UMTS) protocol, a wireless local area network (WLAN) protocol such as for example IEEE 802.X, a suitable short-range radio frequency communication protocol such as Bluetooth, ZigBee or infrared data communication pathway (IRDA). In some embodiments the transceiver 157 may enable communication with other apparatus using more than one communications protocol or interface.

For example the user equipment 151 may communicate using a bridge API 121 (over a WLAN protocol or IP domain communications link) with a bridge 101, and communicate using near field communication (NFC) communications link with a light unit or switch with NFC capacity.

The user equipment user interface (UI) 159 enables a user to input commands to the lighting system. The user interface 159, may for example be keypad, physical switch or touch interface configured to detect a user touch. In some embodiments the UI 159 may be configured to provide information to the user, for example a visual display, for example an LCD, LED or other display technology. In some embodiments a touch screen may provide both input and output functions for the UI 159.

Figure 2A:
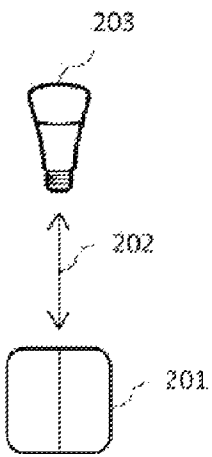
FIGS. 2*a* to 2*d* are schematic diagrams of example pre-configured package or bridgeless arrangements of light units and switches.

With respect to FIGS. 2*a,* to 2*d* example 'ConnectedReady' or pre-configured package arrangements of light units and light switches are shown.

With respect to FIG. 2*a* a first package is shown comprising a single switch 201 coupled via a first link 202 to a single light unit 203.

Figure 2B:
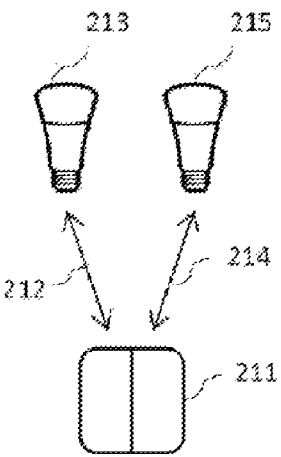

With respect to FIG. 2*b* a second package is shown comprising a single light switch 211 and a first light unit 213 and a second light unit 215. The light switch 211 may comprise a first switch element for controlling the first light unit 213 via a first link 212 and a second switch element for controlling the second light unit 215 via a second link 214.

Figure 2C:
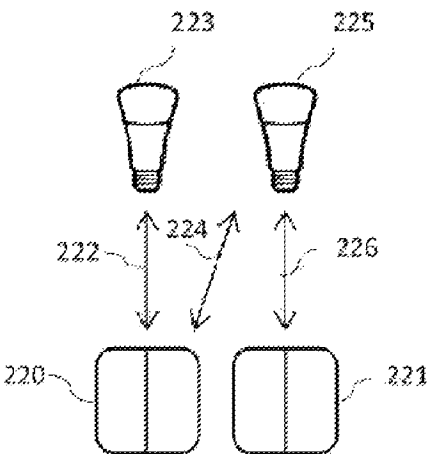

With respect to FIG. 2*c* a third package is shown comprising a first light switch 220, a second light switch 221, a first light unit 223 and a second light unit 225. The first light switch 220 may comprise a first switch element for controlling the first light unit 223 via a first link 222 and a second switch element for controlling the second light unit 225 via a second link 224. Furthermore the second light switch 221 may further control the second light unit 225 via a third link 226.

Figure 2D:
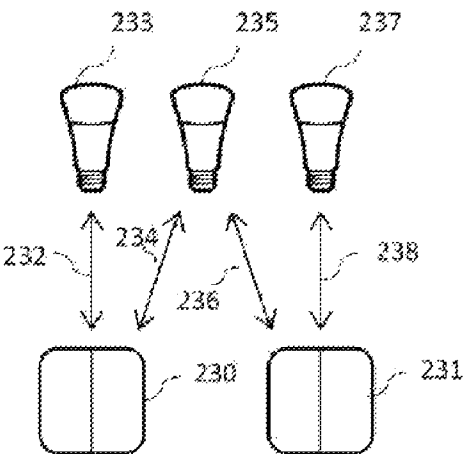

With respect to FIG. 2*d* a fourth package is shown comprising a first light switch 230, a second light switch 231, a first light unit 223, a second light unit 225 and a third light unit 237. The first light switch 230 may comprise a first switch element for controlling the first light unit 233 via a first link 232 and a second switch element for controlling the second light unit 235 via a second link 234. Furthermore the second light switch 231 may comprise a first switch element for controlling the second light unit 235 via a third link 236 and a second switch element for controlling the third light unit 237 via a fourth link 238.

The concept as described herein is to provide the ability to light units, switches and sensors which have been pre-commissioned (or in a 'ConnectedReady' configuration) to easily and without generating errors be configured to operate within a networked lighting system such as shown in FIG. 1. In other words to provide devices with the ability to easily convert from communicating directly with each other to operate within a bridge or central control unit lighting network.

In some embodiments this may be implemented in two parts.

The first part of the re-configuration of the pre-configured or pre-commissioned devices (such as light units) is a device reset and reset cascade operation. The second part of the re-configuration of the devices is a device network configuration operation.

Figure 3:
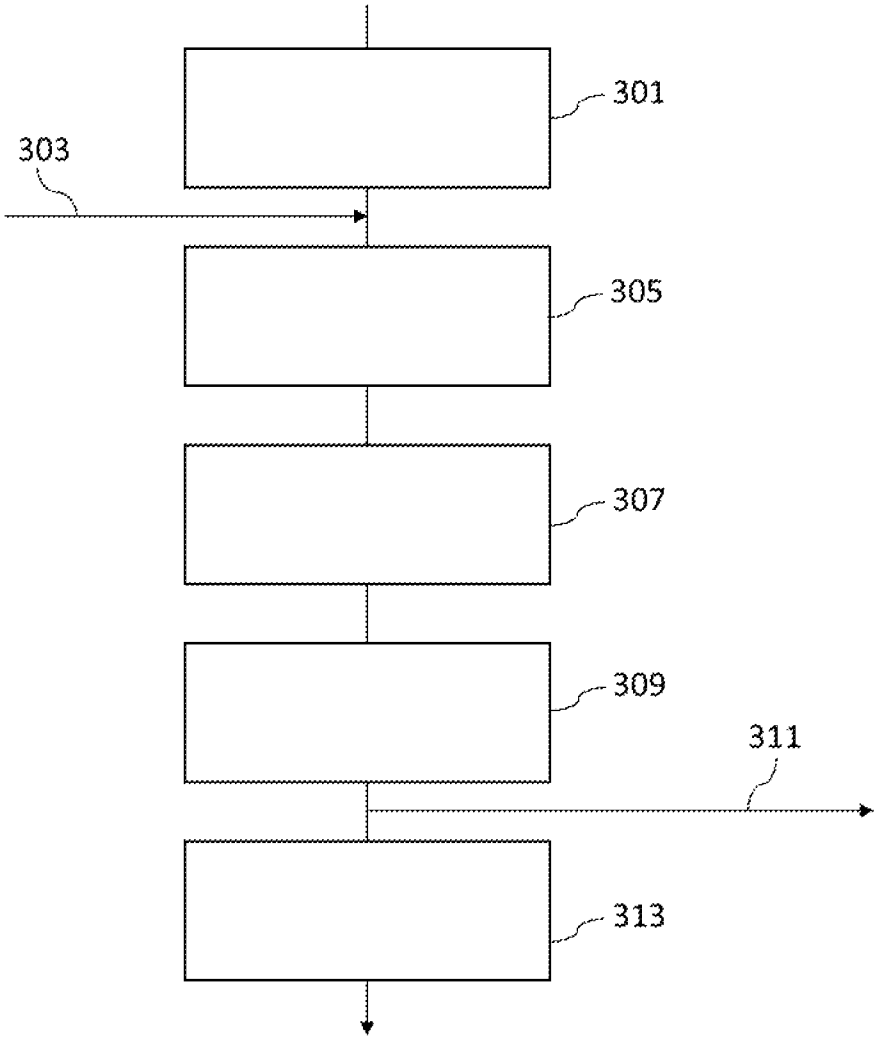
FIG. 3 is a flow diagram of an example cascade reset operation performed by a pre-configured device according to some embodiments.

With respect to FIG. 3 an example device reset and cascade reset operation is shown. The operations may be performed with respect to any of the devices within a package. For example devices such as the light unit 105, light switch 103 or sensor unit 107.

FIG. 3 shows a pre-reset or initial operation where the configuration information is stored in a 'safe' area. In the example here the operation is a configuration update operation. For example the light switch operation configuration details can be changed such as which light unit in the package is switched when the switch is operated (or the light unit or sensor configurations details can be changed). The changes may then be stored within memory on the device. The memory where the configuration memory is stored may in some embodiments be masked, flagged or otherwise protected from being wiped during a reset process.

The operation of updating the configuration data for the device (prior to the receiving a cascade reset command is shown in FIG. 3 by step 301.

The device may be configured to receive a cascade reset signal or input. The cascade reset input may in some embodiments be a physical input such as a mechanical switch on a device. For example the device may be equipped with a 'cascade reset' function button. The button or switch to perform the 'cascade reset' may for example be marked on the device as 'factory new' or 'factory reset'. However in some embodiments the 'cascade reset' operation may be discriminated or distinguished from a reset to factory new command by a separate physical button or switch to the 'factory new' button or switch In some embodiments the pressing or operating of a defined combination of buttons or switches form the 'cascade reset' input. For example in some embodiments a short button press of a 'reset' button may form a reboot input wherein a long button press of more than a determined number of seconds forms the 'cascade reset' input.

In some embodiments the cascade reset input is a command received from a remote device. The cascade reset may for example be received over the wireless communications link. In some embodiments of the cascade reset is an inter-pan command which enables the triggering of a cascade reset from a hue system or other networked lighting system of which the pre-configured device is to be configured to join.

In some embodiments the cascade reset command can be mapped onto an existing network standard (for example Zigbee) command or may be implemented as a manufacturer specific extension.

The operation of receiving the cascade reset input is shown in FIG. 3 by step 303.

The device may then be configured to process the cascade reset input and initialize a cascade reset process to return the device to a 'factory new' mode.

The operation of initializing a reset to factory new operation for the device is shown in FIG. 3 by step 305.

Furthermore the device may be configured to determine whether there are any further devices connected to this device.

The operation of determining whether there are any further devices connected to the device is shown in FIG. 3 by step 307.

The device may then be configured to generate a cascade reset command message to be sent to any of the determined further devices.

The operation of generating of the cascade reset command messages is shown in FIG. 3 by step 309.

The device may then transmit the cascade reset command messages to the determined further devices.

The operation of transmitting the cascade reset commands is shown in FIG. 3 by step 311.

The further devices may then receive the cascade reset command message (in other words for the further device the operation is started at step 303).

The device may then be configured to them perform the reset to factory new operation previously initialized.

The operation of performing the reset to factory new reset is shown in FIG. 3 by step 313.

In the example shown in FIG. 3 the generation of the cascade reset command message and transmission of the cascade reset command message is a unidirectional message. However in some embodiments the transmission of the cascade reset command message is not completed until a positive acknowledgement of receipt is received. The use of acknowledgements may be implemented to prevent low power and/or battery powered devices which only periodically power up their transceivers from missing a cascade reset command message. For similar reasons in some embodiments the transmitter may be configured to transmit multiple cascade reset command messages to each further device to attempt to ensure a successful reception of the message.

In such embodiments the cascade reset operations may pass through all of the devices within a pre-configured package to enable them receptive to connecting and configuring with a bridge device so to be able to operate within the networked lighting system.

In some embodiments the cascade reset operation, as described herein, is configured to trigger or perform a modified 'factory new' reset, with the difference between the 'factory new' and the 'cascade reset' operation being that during the 'cascade reset' operation the configuration data stored in the memory of the device which details the configuration of the device within the pre-configured package is not deleted or wiped. As described previously this may be achieved by masking a section of the memory from the reset operation or by performing a selective deletion or wiping.

For example a cascade reset input may be applied to the light switch 201 for the preconfigured package as shown in FIG. 2A. The light switch 201 may for example receive the cascade reset input in the form of a physical button or switch press and then initialize a cascade reset process which would involve determining the light unit 203, and generating a cascade reset command message to be transmitted to the light unit 203 by the link 201. The light switch 201 then performs its reset operation. The light unit 203 receives the cascade reset command message from the light switch 201 and then, having determined that there are no further connected devices performs its own reset operation.

A further example of a cascade reset process may be described with respect to the preconfigured package as shown in FIG. 2C. In this example the first light switch 220 receives the cascade reset input. The first light switch 220 can then determine the further connected devices as the first light unit 223 and the second light unit 225 and then generate and transmit cascade reset command messages to the first light unit 223 via link 222 and the second light unit 225 by the link 224. The first light unit 223 can then receive the message and initialize a cascade reset operation, determine that there is no further connected devices and then perform a reset operation on itself. The second light unit 225 receives the message and initializes a cascade reset operation. The second light unit 225 can then determine that there is a further connected device, the second light switch 221, and generates and transmits a further cascade reset command message to the second light switch 221 over the link 226. The second light switch then receives the further cascade reset command message and initializes a cascade reset. The second light switch 221 determines that there are no further connected devices and then resets itself.

Thus in both examples only a single input is required in order to reset all of the devices within the package such that they are ready to implement the second part of the configuration.

In the examples as described above the determination of further connected devices may also include the determination of the device which also sent the cascade reset command message and thus a cascade reset command message is generated and transmitted back. In such embodiments the operation of initializing a cascade reset operation may block any further received cascade reset commands from being executed until the device has been configured to operate with respect to the bridge.

Figure 4:
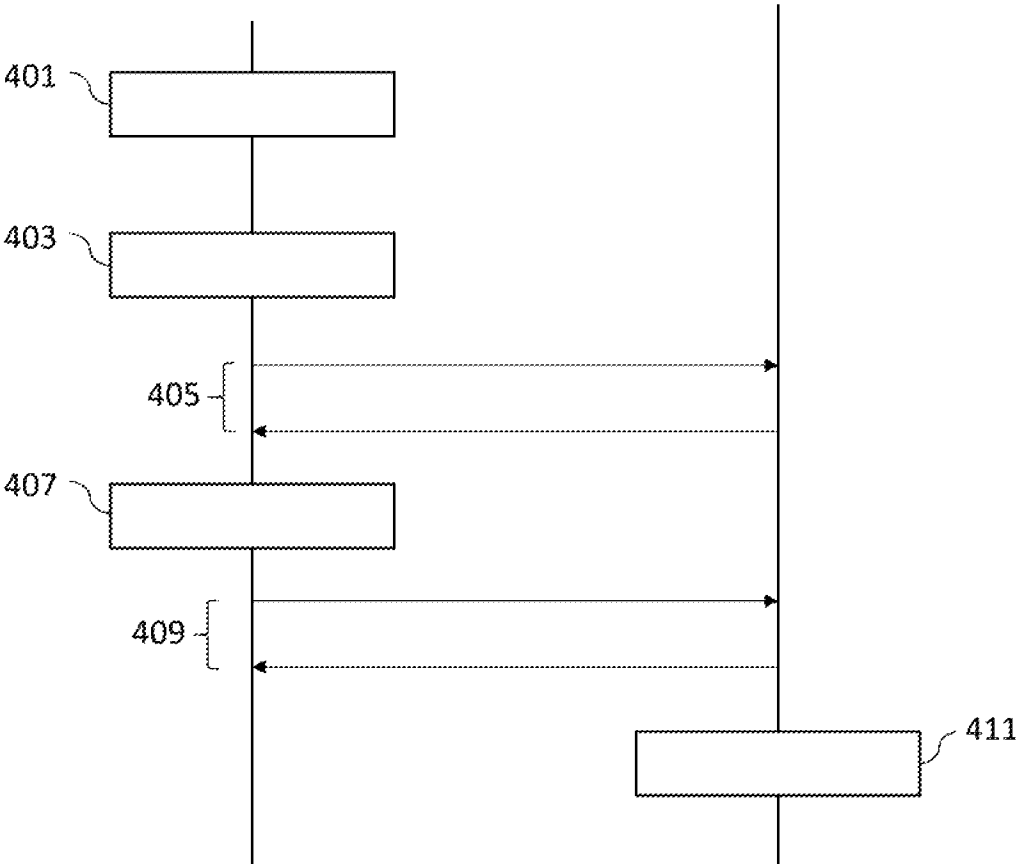
FIG. 4 is a flow diagram of an example networked lighting system configuration between a cascade reset device and a bridge according to some embodiments.

With respect to FIG. 4 the second part of the conversion from pre-configured package to bridge networked light system operations is shown in further detail. FIG. 4 thus shows example operations for reconfiguring the devices to operate within the networked light system following the operation of performing a reset operation.

The device, having performed a cascade reset, may then start to perform an open network search. The open network search attempts to find any connected lighting system networks, for example a network controlled by the bridge 101. In other words the device may be configured to listen for network messages transmitted from the bridge 101 or other devices which may be configured to act as traffic forwarding nodes within the network.

Furthermore as described herein in some embodiments the device can be configured to mask or block any incoming cascade reset commands or requests to prevent any looping or circulation of the resetting process.

The operation of searching for an open network is shown in FIG. 4 by step 401.

The device may then be configured to identify any determined open network as being suitable. For example the device may be configured to determine whether the signal strength is suitable or that the bridge operating the network is able to manage the device.

The operation of determining an open network and identifying the open network is suitable for configuring the device is shown in FIG. 4 by step 403.

The device may then be configured to start a network registration process with the bridge. For example where the network lighting system is a Hue system a Hue process for registering the device at the bridge is performed.

The operation of initially registering the device at the bridge is shown in FIG. 4 by step 405.

In some embodiments the registration of the device at the bridge causes the bridge to generate and transmit to the device a 'configuration request' message. This may be implemented as part of the registration process.

The device may be configured to receive the configuration request message. The device may for example comprise a request configuration interface or application which when receiving the configuration request is configured to determine or retrieve the configuration data associated with the device prior to the cascade reset and when the device was part of the pre-configured package. For example with respect to a light switch the configuration data may identify the light unit or light units which were controlled by the light switch. Similarly with respect to a light unit the configuration data may identify a light intensity or light color which is to be output when the light unit is 'activated'. Thus the device may have access to configuration data such as the group, scene, or other connected device data which were stored on memory in the device (for example stored in the masked memory area described previously).

The operation of determining the pre-reset configuration data is shown in FIG. 4 by step 407.

The device may then be configured to communicate the configuration data to the bridge.

The operation of transmitting or communicating the configuration data to the bridge is shown in FIG. 4 by step 409.

The bridge may then be configured to store this configuration data or process this configuration data in order to generate or set up the logical links between the devices from the pre-configured package. Thus after the bridge has discovered all of the 'new' devices it queries all of the 'new' devices for their configuration information and creates the control rules accordingly.

The operation of storing the configuration data or processing the configuration data is shown in FIG. 4 by step 411.

For example this may include a transformation from implementing controls using the ZLL format (in other words for the example shown in FIG. 2A when a button on light switch 201 is pressed the light switch sends a 'LightOn' command to the first light switch 203) to a Hue format (when a button on the light switch 201 is pressed, it sends a 'pressed' notification to the bridge, which in turn sends a 'LightOn' command to the first light unit 203 based on a rule provided in the bridge). In some embodiments, where the device is battery powered and does not maintain an 'always on' communications link the device may be configured to operate such that it polls frequently for a defined period of time after the cascade reset in order to connect and configure itself with the bridge.

Figure 5:
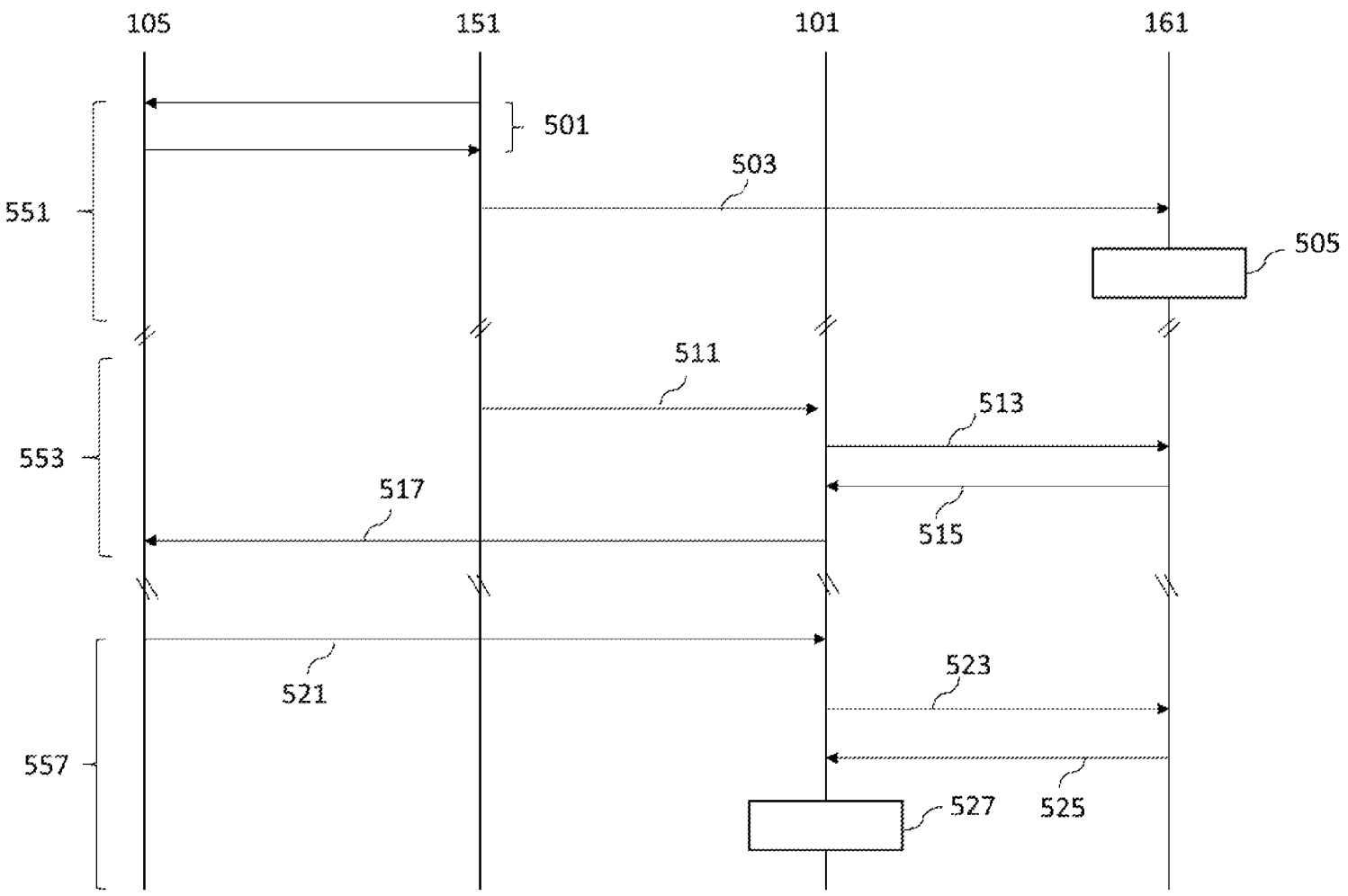
FIG. 5 is a flow diagram of further example networked lighting system configuration for a device according to some embodiments.

With respect to FIG. 5 a further conversion from a pre-configured package to a network lighting system control example is shown. In the examples shown with respect to FIG. 5 a cloud device or external server is employed to store configurations data such that when the device is reset the configuration data is not lost and can be retrieved by the bridge to generate the logical links and rules for operating the devices within the networked lighting system.

The example shown in FIG. 5 may be divided into three parts. The three parts may be a first or registration part 551 where the devices are registered on the external server, a second or reset part 553 where the devices are reset, and a third or configuration part 557 where the devices communicate and configure themselves on the bridge which may retrieve the configuration data from the external server 161.

In the example shown in FIG. 5 the light unit 105 is the device which is registered/reset/configured. However these operations may be performed on each of the devices in the pre-configured package.

The registration part 551 of operations may be performed by a user connecting to the external server 161. For example in some embodiments the registration of the device 105 may be performed by communicating with the device 105 using a user equipment 151 with near field communication (NFC) capacity. Thus in some embodiments the user equipment 151 may detect a NFC capacity within the device 105 and retrieve the hex code identifying the device 105 and configuration data associated with the device 105.

The operation of communicating with the device and retrieving an identifier (the hex code) and the configuration data is shown in FIG. 5 by step 501.

The user equipment 151 may then register the hex code and configuration data on the external server 161.

The transmission of the identifier and configuration data from the user equipment to the external server 161 is shown in FIG. 5 by step 503.

The external server 161 may then be configured to register and store the identifier and the configuration data within the memory of the external server 161.

The operations of registering and storing the identifier and configuration data on the external server is shown in FIG. 5 by step 505.

Thus in such a manner the device is registered on the external server so that the configuration information may be retrieved even if the information is deleted or wiped from the device (for example when implementing a complete memory reset operation).

Although it is shown that the user equipment 151 determines or receives the device 105 identity and configuration data using a NFC connection and passes this to the external server 161 it is understood that the information may be passed to the external server 161 using any suitable manner. For example the device may be configured to register this information to the external server 161 directly. Furthermore in some embodiments a user may enter the details on the external server 161 implementing a suitable user interface.

Furthermore in some embodiments the role of the external server 161 as described herein may be implemented within any suitable computing device. For example the user equipment 151 may comprise the external server 161. In other words the user equipment receives the configuration information and stores it internally, for example as part of the working memory space of a lighting control application or program.

Although this registration part may be implemented when the devices for the pre-configured package are initially installed it is understood that this registration method may be implemented at any suitable time, such as following changing the configuration data on the device or as part of a bridge installation sequence with instructions provided by an application running of the user equipment.

The second or reset part 553 may be implemented following the registration of all of the devices within the pre-configured package.

The reset part may be initially trigged by a user equipment 151 running a program or application controlling an installation of the bridge to convert a pre-configured package of devices to operate within the network lighting system. For example the user equipment 151 may be configured to generate and transmit a command message to the bridge to trigger a reset of the devices.

The operation of generating a transmitting a reset command message from the user equipment to the bridge is shown in FIG. 5 by step 511.

In some embodiments the reset trigger may be generated and transmitted by one of the devices in the pre-configured package of devices.

The bridge having received the reset command message may be configured to generate and transmit an identification request to the external server 161 requesting the identification data for all of the devices from the pre-configured package of devices which have been registered.

The operation of generating and transmitting from the bridge 101 to the external server 161 an identity request for the addresses for the devices is shown in FIG. 5 by step 513.

The external server 161, having received the request for identification of the devices may be configured to generate and transmit a response to the request. For example the response may comprise the registered hex codes for the identification of the devices.

The operation of transmitting the response from the external server to the bridge is shown in FIG. 5 by step 515.

The bridge may then be configured to implement a cascade style reset by generating a cascade reset command message and transmitting the message to one of the devices. The cascade reset may then be propagated though the pre-configured package of devices in the same manner as discussed above.

The operations of generating and transmitting a cascade reset command message from the bridge to a device to initialize a cascade reset chain is shown in FIG. 5 by step 517.

Although the example described herein shows the generation and transmission of a cascade reset command message to one of the devices to start a chain of resets it is understood that in some embodiments the bridge may be configured to generate and transmit a reset command message to each of the devices.

In such a manner the devices are reset and ready to be connected and configured with the bridge.

The third or configuration part 557 may start with the device 105 having been reset searching for an open network and a bridge 101 to connect to. The device 105 having determined a suitable bridge may generate and transmit a registration or connection request to the bridge 101.

The operations of generating and transmitting a connection request to the bridge 101 is shown in FIG. 5 by step 521.

The bridge 101, having received the request and using the identifier of the device generate and transmit to the external server 161 a configuration request.

The operations of generating and transmitting the configuration request from the bridge to the external server is shown in FIG. 5 by step 523.

The external server, having received the configuration request, may then be configured to retrieve or determine the configuration data associated with the device identified within the request. The external server may then generate and transmit a response to the request comprising the determined configuration data such as the data stored during the registration part 551.

The operations of retrieving the configuration data associated with the device identified in the request and generating and transmitting a response comprising the configuration data is shown in FIG. 5 by step 525.

The bridge 101, having received the configuration may then process the configuration data in a manner similar to that described previously. For example the bridge may then be configured to generate or set up the logical links between the devices from the pre-configured package. Thus after the bridge has discovered all of the 'new' devices it queries all of the 'new' devices for their configuration information and creates the control rules accordingly.

The operation of processing the configuration data is shown in FIG. 5 by step 527.

In such a manner the pre-configured package of devices may be easily and without error be converted to operate within a networked lighting system.

Furthermore, while the above has been described in terms of a lighting system comprising lighting devices which emit light, and lighting control commands which control the emitted light, note that the teachings above may alternatively or additionally be applied in relation to other types of environmental control system comprising one or more other types of environmental-control devices such as: one or more window treatments (e.g. electronically controlled blinds) and/or other daylight harvesting devices (e.g. a heliostat), and/or one or more HVAC devices (heating, ventilation and/or air-conditioning). Therefore anywhere in herein where features are described in terms of a lighting system, lighting devices and controlling lighting; any such features may equally apply to any system comprising a lighting system and/or other environmental-control system comprising one or more lighting devices and/or environmental-control devices (e.g. HVAC devices), for controlling the light and/or other environmental function(s) respectively.

It will be appreciated that the above embodiments have been described only by way of example. Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. A single processor or other unit may fulfil the functions of several items recited in the claims. The mere fact that certain measures are recited in mutually different dependent claims does not indicate that a combination of these measures cannot be used to advantage. A computer program may be stored and/or distributed on a suitable medium, such as an optical storage medium or a solid-state medium supplied together with or as part of other hardware, but may also be distributed in other forms, such as via the Internet or other wired or wireless telecommunication systems. Any reference signs in the claims should not be construed as limiting the scope.

The invention claimed is:

1. A lighting system device for a pre-configured lighting system, wherein the lighting system device is coupled directly with at least one further lighting system device in the pre-configured lighting system based on configuration data associated with the lighting system device and the at least one further lighting system device, the lighting system device further configured to:

store the configuration data associated with the lighting system device and the at least one further lighting system device such that it is not deleted on performing a reset;

receive a reset input;

cascade the reset input to any coupled lighting system devices within the pre-configured lighting system package;

reset the lighting system device; and determine and register the lighting system device on a central control unit, such that the central control unit is configured to access the configuration data and restore a pre-configured lighting system functionality.

2. The lighting system device as claimed in claim 1, wherein the lighting system device configured to store the configuration data is configured to store the configuration data on an external server.

3. The lighting system device as claimed in claim 2, wherein the lighting system device is configured to communicate the configuration data to a user equipment, wherein the user equipment is configured to communicate the configuration data to the external server.

4. The lighting system device as claimed in claim 1, wherein the lighting system device configured to store the configuration data is configured to store the configuration data within a portion of a memory which is masked from being deleted on the lighting system device being reset.

5. The lighting system device as claimed in claim 4, wherein the lighting system device is further configured to:

receive a request from the central control unit for the configuration data; and generate a response to the request, the response comprising the stored configuration data; and transmit to the central control unit the response such that the central control unit has access to the configuration data.

6. The lighting system device as claimed in claim 1, wherein the reset input is a physical input and/or a received reset command message.

7. The lighting system device as claimed claim 1, wherein the lighting system device configured to cascade the reset input to any coupled lighting system devices within the pre-configured lighting system package is configured to:

determine any directly coupled lighting system devices;

generate a reset command message; and transmit the reset command message to each of the directly coupled lighting system devices to cascade the reset input.

8. The lighting system device as claimed claim 1, wherein the lighting system device is configured to mask any further received reset inputs after receiving the first reset input for a determined period.

9. A central control unit for configuring a pre-configured lighting system lighting system device, the central control unit configured to:

register a reset lighting system device at the central control unit;

request configuration data associated with the lighting system device and at least one further lighting system device;

receive the configuration data; and generate a logical link between the lighting system device and at least one further lighting system device to restore a pre-configured lighting system functionality between the lighting system device and at least one further lighting system device.

10. The central control unit as claimed in claim 9, wherein the central control unit configured to request configuration data associated with the lighting system device and at least one further lighting system device is further configured to generate and transmit to an external server a request for configuration data associated with the lighting system device, and receive the configuration data within a response to the request from the external server.

11. A networked lighting system comprising:

at least two lighting system devices as claimed in claim 1; and the central control unit.

12. A method for configuring a lighting system device, the lighting system device configured to operate as part of a pre-configured lighting system, wherein the lighting system device is coupled directly with at least one further lighting system device in the pre-configured lighting system based on configuration data associated with the lighting system device and the at least one further lighting system device, the method comprising:

storing the configuration data associated with the lighting system device and the at least one further lighting system device such that it is not deleted on performing a reset;

receiving a reset input;

cascading the reset input to any coupled lighting system devices within the pre-configured lighting system package;

resetting the lighting system device; and determining and registering the lighting system device on a central control unit, such that the central control unit is configured to access the configuration data and restore a pre-configured lighting system functionality.

13. The method as claimed in claim 12, wherein storing the configuration data comprises storing the configuration data on an external server.

14. The method as claimed in claim 12, wherein storing the configuration data comprises storing the configuration data within a portion of a memory which is masked from being deleted when the lighting system device is reset.

15. A computer program for controlling a lighting system device for a pre-configured lighting system, wherein the lighting system device is coupled directly with at least one further lighting system device in the pre-configured lighting system based on configuration data associated with the lighting system device and the at least one further lighting system device, and the computer program comprising code embodied on one or more computer-readable storage media and configured so as when run on the lighting system device to perform operations of:

storing the configuration data associated with the lighting system device and the at least one further lighting system device such that it is not deleted on performing a reset;

receiving a reset input;

cascading the reset input to any coupled lighting system devices within the pre-configured lighting system package;

resetting the lighting system device; and determining and registering the lighting system device on a central control unit, such that the central control unit is configured to access the configuration data and restore a pre-configured lighting system functionality.

* * * * *